United States Patent [19]

Mio

[11] 4,150,713

[45] * Apr. 24, 1979

[54] FLEXIBLE PATTERN TO BE USED FOR CASTING MOLDS

[75] Inventor: Mitushi Mio, Sumoto, Japan

[73] Assignee: Awaji Sangyo Kabushikikaishi, Hyogo, Japan

[ * ] Notice: The portion of the term of this patent subsequent to Jun. 7, 1994, has been disclaimed.

[21] Appl. No.: 779,831

[22] Filed: Mar. 21, 1977

[30] Foreign Application Priority Data

Mar. 27, 1976 [JP] Japan ..... 51-034091

[51] Int. Cl.[2] ..... B22C 7/00

[52] U.S. Cl. ..... 164/237; 164/248; 164/249; 249/65

[58] Field of Search ..... 164/237, 248, 249; 249/184, 186, 65; 46/24–26, 31

[56] References Cited

U.S. PATENT DOCUMENTS

| | | | |
|---|---|---|---|
| 1,130,947 | 3/1915 | Watson | 249/184 X |
| 4,027,717 | 6/1977 | Mio | 164/44 |

FOREIGN PATENT DOCUMENTS

| | | | |
|---|---|---|---|
| 846151 | 8/1960 | United Kingdom | 46/25 |

*Primary Examiner*—Othell M. Simpson
*Assistant Examiner*—J. Reed Batten, Jr.
*Attorney, Agent, or Firm*—Wenderoth, Lind & Ponack

[57] ABSTRACT

A flexible pattern for forming casting molds can be withdrawn from the mold, without need of partitioning and reassembling, and includes a pattern member made by coupling a plurality of outer plates, having a configuration corresponding to a desired predesigned casting, by means of joint members, which are freely removable, and an airtight bag installed in the inner periphery of the pattern member. The pattern member and the airtight bag are united in a single body.

5 Claims, 4 Drawing Figures

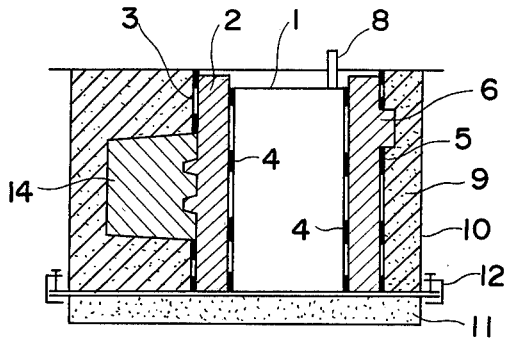
FIG. 1
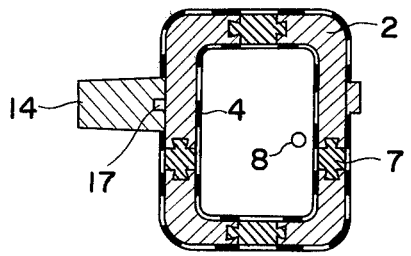
FIG. 2
FIG. 3
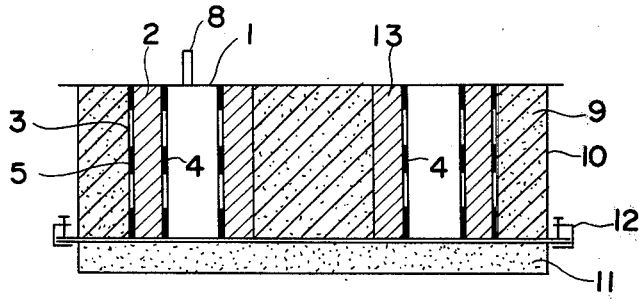
FIG. 4
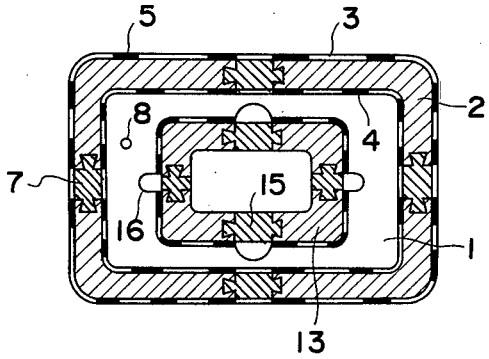

FLEXIBLE PATTERN TO BE USED FOR CASTING MOLDS

BACKGROUND OF THE INVENTION

1. Field of the Invention

The present invention relates to a flexible pattern to be used for forming casting molds.

2. Description of the Prior Art

There have been developed several techniques relating to methods for forming casting molds on an industrial scale. However, all these prior techniques are attended with disadvantages, that such various operations such as partition of the pattern and separation of the master mold, core and drag are required.

In order to eliminate these disadvantages, a novel method for forming a casting mold has already been proposed by the same inventor of the present invention, in which a casting mold can be prepared in a simple way by using a flexible pattern, as is disclosed in U.S. patent application Ser. No. 614,155 filed on Sept. 17, 1975, now U.S. Pat. No. 4,027,717.

The present invention is a further improvement of the flexible pattern disclosed in the above mentioned U.S. Pat. No. 4,027,717.

SUMMARY OF THE INVENTION

The first embodiment of the present invention relates to a flexible pattern including a pattern member formed by coupling a plurality of outer plates having an outer configuration corresponding to the measurements of a desired predesigned casting by means of joint members which are freely removable from the plates, and an airtight bag installed in the inner periphery of the pattern member, the pattern member and the airtight bag being united in a single body.

The pattern member may be provided with a protruding part member of a desired shape in such a manner as to be freely attachable to and removable from the pattern member.

A second embodiment of the invention relates to a flexible pattern composed of an outer pattern member made by coupling a plurality of outer plates, having an outer configuration corresponding to the desired outer shape of a predesigned casting, by means of freely removable joint members, an inner pattern member having an inner configuration corresponding to the desired inner shape of a desired predesigned casting, and an empty airtight bag arranged between the inner and outer pattern members, the outer pattern member, the airtight bag and the inner pattern member being united in a single body.

The inner pattern member is formed by coupling a plurality of inner plates by means of freely removable joint members.

Therefore, by employing the flexible pattern of the present invention there can be obtained an advantage that the flexible pattern can be withdrawn, without the need of separating the master mold, core and drag, as is usual in conventional methods, since the outer plates are movable inwardly and the inner plates are movable outwardly upon the removal of the joint members in the sliding movement and upon the discharge from the airtight bag of a fluid supplied therein under pressure. That is, as the master mold, core and drag are not required to be separated and reassembled according to the present invention, the process steps can be shortened, dimensional errors become few and no cast swell occurs. Moreover, as the flexible pattern of the present invention can be repeatedly employed, it is a very effective labour saving device.

BRIEF DESCRIPTION OF THE DRAWINGS

The present invention will be described in more detail below with reference to the attached drawings, wherein:

FIG. 1 is a longitudinal section of a flexible pattern according to a first embodiment of the invention, shown surrounded by molding sand;

FIG. 2 is a horizontal section through the flexible pattern shown in FIG. 1, but with the sand removed;

FIG. 3 is a longitudinal section of a flexible pattern according to a second embodiment of the invention, shown with molding sand; and FIG. 4 is a horizontal section through the flexible pattern shown in FIG. 3, but with the sand removed.

DETAILED DESCRIPTION OF THE INVENTION

In FIGS. 1 and 2 an airtight bag 1 is positioned within outer plates 2. An outer cloth member 3 surrounds plates 2. A protruding pattern part 6 may extend from one plate 2. Joint members 7 separate the outer plates. Molding sand 9 surrounds the flexible pattern within a master mold 10 which is supported on a drag 11 attached to mold 10 by clamp 12.

In the process of preparing a casting mold by the flexible pattern of the first embodiment of the present invention, a flexible pattern is formed by coupling a plurality of outer plates, formed to have an outer configuration and measurements corresponding to the configuration of a predesigned casting outer surface, by means of joint members 7, which are constructed to be slidably withdrawable from between adjacent outer plates. The outer periphery of the outer plates is covered by outer cloth member 3, which may be fixed to the outer plates by using a bonding agent 5. The outer plates 2 and joint members 7 are designed so that the joint outer surfaces thereof conform generally to the shape of the predesigned casting outer surface. For instance, when a protruding part 6 is required to form the predesigned casting outer surface, necessary plates 2 are provided with such protrusions. When the protruding part is large, as is shown by large protruding part 14, it may be a separate element supported on an outer plate 2 by projections 17 so as to be freely attachable and removable therefrom. That is, the large protruding part 14, which has a greater size than the distance of inward movement of the flexible pattern, remains in the sand and is separated from the outer plates 2 when the flexible pattern is withdrawn from the formed sand mold. Part 14 is then removed after the withdrawal of the flexible pattern. This arrangement is very convenient for practical operation.

The practice of the present invention on an industrial scale will now be explained. A bonding agent 4 is applied to the airtight bag 1. Then, the airtight bag is positioned within the outer plates, formed to correspond to the measurements and shape of the predesigned casting outer surface, and bag 1 is thus attached to plates 2, whereby the flexible pattern of this embodiment of the present invention is formed. Air is then supplied into the interior of the airtight bag through the hole 8, and the flexible pattern of predetermined shape is obtained. Then, the thus formed pattern is placed on the known drag 11 and is thereafter covered by the master mold 10. A known molding sand, for example a flowing self-hardening sand 9, is filled into master mold 10 around the pattern. After the hardening of the molding sand to form the desired mold, the joint members 7 are pulled out, and the air within the airtight bag 1 is discharged therefrom. Then, the airtight bag 1 together with the outer plates 2 and outer cloth member 3 are withdrawn as one body. Thus, the withdrawal of the flexible pattern from the sand mold according to the present invention is made possible by inward movement of the outer plates 2 caused by gaps formed between the outer plates 2 upon the removal of the joint members 7. The size of the gaps formed between the outer plates upon the removal of the joint members 7 may be varied depending upon the size of the pattern, the scale of a protruding part and the degree of reverse taper of the joint members.

Next, a second embodiment of the invention will be explained with reference to FIGS. 3 and 4.

An outer pattern member is prepared by coupling outer plates 2 by means of joint members 7, as is explained above with reference to the first embodiment of the invention. The outer cloth member 3 is fixed to the outer plates 2 by using the bonding agent 5. Further, an inner pattern member is similarly prepared by coupling inner plates 13 by means of joint members 15 along an inner surface of a tubular or hollow shaped airtight bag 1. The inner surfaces of inner plates 13 and joint members 15 correspond in measurements and shape to the configuration of a predesigned casting inner surface. Fluid is supplied into the airtight bag 1 through the hole 8 under pressure. This holds outer plates 2 of the outer pattern outwardly and the inner plates 13 of the inner pattern inwardly, thereby bringing the overall flexible pattern into a configuration which exactly corresponds with the predesigned casting configuration. The joint members 15 in the inner plates and the joint members 7 in the outer plates are so constructed that they can easily be removed. The airtight bag 1, at positions thereof abutting the joint members 15, is provided with slack portions 16.

Then, the above described complete flexible pattern is placed on the known drag 11 and is then covered by the master mold 10. Thereupon, the volume within inner plates 13 and the volume outside outer plates 2 of the pattern are filled with a known molding sand, for example a flowing self-hardening sand. After the sand has been hardened, the joint members 7 and 15 of the outer plates and inner plates are removed, and the fluid is discharged from the airtight bag through the hole 8. Due to the gaps formed, after the removal of the joint members, the outer plates 2 move inwardly, and the inner plates 13 move outwardly. Due to such movements of the plates the complete flexible pattern can be easily removed from the formed sand mold. By pouring a molten metal into the completed sand mold, a desired hollow casting can be obtained.

A reinforcing mold core grid may be attached to the mold drag. A conventional mold cope (not illustrated) may be employed.

As above mentioned, the flexible pattern of the present invention is very convenient for practical operation, because the displacement of the flexible pattern is easily effected due to the gaps formed after the removal of the joint members installed in the outer and inner pattern members and due to discharging the fluid supplied under pressure into the airtight bag therefrom. Even when the pattern includes a large protruding part, it can easily be installed according to the first embodiment of the invention.

Obviously, various modifications and variations of the present invention are possible in light of the spirit of the present invention. It is, therefore, to be understood that within the scope of the appended claims the present invention may be practiced otherwise than as specifically described.

What is claimed is:

1. A flexible pattern for use in forming a casting mold, said flexible pattern comprising:

a hollow outer pattern member formed by a plurality of outer plates, adjacent edges of said plates being coupled by elongated outer joint members extending between said adjacent edges, the exterior surfaces of said plates and said joint members together having a configuration corresponding to the shape of a predesigned casting outer surface, said joint members being selectively freely slidably removable from between said plates in directions substantially parallel to said adjacent edges, to thereby form gaps between said plates;

a fluid tight bag positioned within the interior of said pattern member and attached to inner surfaces of said plates;

whereby, upon supplying fluid into the interior of said bag, said bag expands against the interior of said pattern member; and upon the removal of said joint members from between said plates and upon the discharge of fluid from within the interior of said bag, said bag comprises means for pulling said plates inwardly.

2. A pattern as claimed in claim 1, further comprising an outer cloth member surrounding said pattern member, said outer cloth member being attached to outer surfaces of said plates.

3. A pattern as claimed in claim 1, further comprising a protruding member selectively removably attached to the outer surface of one of said plates, said protruding member having a configuration corresponding to a protrusion of said predesigned casting outer surface, said protruding member extending outwardly from said outer surface of said one plate by a distance greater than the distance by which said plate is pulled inwardly by said bag.

4. A pattern as claimed in claim 1, further comprising an inner pattern member positioned within said outer pattern member, said inner pattern member having an inner surface having a configuration corresponding to the shape of a predesigned casting inner surface, said bag being attached to the outer surface of said inner pattern member.

5. A pattern as claimed in claim 4, wherein said inner pattern member is formed by a plurality of inner plates, adjacent edges of said inner plates being coupled by elongated inner joint members extending between said adjacent edges of said inner plates, the inner surfaces of said inner plates and said inner joint members together having a configuration corresponding to the shape of the predesigned casting inner surface, said inner joint members being selectively freely slidably removable from between said inner plates in directions substantially parallel to said adjacent edges of said inner plates, to thereby form gaps between said inner plates, whereby upon removal of said inner joint members from between said inner plates and upon said discharge of fluid from within said interior of said bag, said bag comprises means for pulling said inner plates outwardly.

* * * * *